US007739752B2

(12) United States Patent
Tsujimoto

(10) Patent No.: US 7,739,752 B2
(45) Date of Patent: Jun. 22, 2010

(54) HEADGEAR

(75) Inventor: Takeshi Tsujimoto, 28-3, Nishiki-cho, Kawachinagano-shi, Osaka 586-0031 (JP)

(73) Assignee: Takeshi Tsujimoto, Osaka (JP)

( * ) Notice: Subject to any disclaimer, the term of this patent is extended or adjusted under 35 U.S.C. 154(b) by 155 days.

(21) Appl. No.: 11/556,996

(22) Filed: Nov. 6, 2006

(65) Prior Publication Data

US 2007/0261152 A1 Nov. 15, 2007

(30) Foreign Application Priority Data

Nov. 24, 2005 (JP) ..... 2005-338816

(51) Int. Cl.
*A42B 1/08* (2006.01)

(52) U.S. Cl. ..... 2/424; 2/425; 2/410

(58) Field of Classification Search ..... 2/410, 2/411, 412, 414, 425, 423, 424
See application file for complete search history.

(56) References Cited

U.S. PATENT DOCUMENTS

| | | | | |
|---|---|---|---|---|
| 1,432,471 | A | 10/1922 | Lacrotte | |
| 2,458,025 | A * | 1/1949 | Portal | 2/421 |
| 3,527,461 | A | 9/1970 | Prater | |
| 3,768,100 | A | 10/1973 | Colman et al. | |
| 3,992,722 | A * | 11/1976 | Rhee | 2/424 |
| 4,667,343 | A * | 5/1987 | Bettis | 2/18 |
| 5,038,047 | A * | 8/1991 | Still | 250/516.1 |
| 5,177,815 | A * | 1/1993 | Andujar | 2/411 |
| 5,768,715 | A * | 6/1998 | Gregg et al. | 2/411 |
| 6,056,674 | A | 5/2000 | Cook | |
| 6,438,763 | B2 * | 8/2002 | Guay et al. | 2/424 |
| 2004/0209744 | A1 * | 10/2004 | Tsujimoto | 482/83 |

FOREIGN PATENT DOCUMENTS

| | | |
|---|---|---|
| EP | 0 825 368 | 2/1998 |
| GB | 169544 | 10/1921 |
| JP | 2004-267313 | 9/2004 |
| JP | 2004321209 A * | 11/2004 |

* cited by examiner

*Primary Examiner*—Shaun R Hurley
*Assistant Examiner*—Andrew W Sutton
(74) *Attorney, Agent, or Firm*—Knobbe Martens Olson & Bear LLP

(57) ABSTRACT

In a gear main body (1), a mouth opening portion (6) through which a mouth portion can be seen is formed in addition to and separately from an eye opening portion (5) through which both eyes can be seen. A part above the eye opening portion (5) covers a forehead portion, a part between the eye opening portion (5) and the mouth opening portion (6) covers cheek portions and a nose portion, and a part below the mouth opening portion (6) covers a lower jaw portion. A surface-side skin material (2) and a back-face-side skin material (3) are split in a vertical direction between the eye opening portion (5) and the mouth opening portion (6) to form a gap (9). At this gap (9), end portions facing each other at the gap (9) are connected by connecting means in such a manner that left and right spaces between the surface-side skin material (2) and the back-face-side skin material (3) communicate with each other. A shock absorbing material (4) is filled also in the communicating space at the gap (9).

7 Claims, 4 Drawing Sheets

Background Art

HEADGEAR

BACKGROUND OF THE INVENTION

1. Field of the Invention

The present invention relates to a headgear, specifically to a headgear used in various fighting sports such as karate and boxing, and particularly to a headgear worn on a head portion of a player and used for protecting mainly a face of the player from hits by an opponent.

2. Description of the Related Art

In recent years, in matches and practice of karate and boxing, a player M wears a headgear 61 on his/her head portion so as to protect mainly his/her face from hits given by an opponent as shown in FIG. 6. In a case of a prior-art headgear 61, as shown in FIG. 7, a shock absorbing material 64 is filled between a surface-side skin material 62 and a back-face-side skin material 63 and an opening portion 65 through which eyes of the player M can be seen is formed in the front. The player M continues to play while watching movement of the opponent through the opening portion 65, impacts of the hits by the opponent lessened by the shock absorbing material 64 filled between both the surface-side and back-face-side skin materials 62, 63 (Japanese Patent Application Laid-open No. 2004-267313).

On the other hand, at a peripheral edge of the opening portion 65 through which the eyes of the player M can be seen, the surface-side skin material 62 and the back-face-side skin material 63 are sewn together substantially without exposing sewing thread on a surface side. By finishing the peripheral edge of the opening portion 65 by sewing the surface-side skin material 62 and the back-face-side skin material 63 together with the sewing thread and then turning them inside out, a seam of the sewing thread is positioned on a back side of the surface-side skin material 62 at the peripheral edge of the opening portion 65. A periphery of the opening portion 65 positioned right in front frequently receives hits from the opponent and is conspicuous, the sewing thread and the seam between the front-side and back-face-side skin materials are hidden behind the peripheral edge of the opening portion 65 to thereby prevent damage to the sewing thread and increase beauty without making the sewing thread and the seam conspicuous.

However, in the case of the above prior-art headgear 61, it cannot be said that protection of a nose portion of the player is sufficient and also it is difficult for the player to speak or breathe. Reversely, if the whole nose portion of the player is protected sufficiently and also a front face of a mouth portion is opened so that the player can easily speak and breathe, protection of a lower jaw portion becomes insufficient.

Moreover, although the shock absorbing material 64 filled between both the surface-side and back-face-side skin materials 62 and 63 is made thick to thereby recess the nose portion of the player inside the opening portion 65, the nose portion of the player is not covered with the shock absorbing material 64 and therefore the nose portion directly receives a hit from the opponent sometimes.

On the other hand, because the mouth portion of the player is mostly covered with the headgear 61 so as to protect as broad an area as possible of the face of the player, the player feels pressure on his/her mouth portion and has difficulty in speaking and breathing.

SUMMARY OF THE INVENTION

Therefore, the present invention has been made with the above circumstances in view and it is an object of the invention to provide a headgear which can sufficiently protect a face including a nose portion of a player and with which the player can easily speak and breathe.

According to the invention, there is provided a headgear comprising:

a gear main body;

a surface-side skin material;

a back-face-side skin material; and a shock absorbing material filled between the surface-side and back-face-side skin materials, characterized in that an eye opening portion in a closed shape and through which both eyes can be seen is formed in the front and a mouth opening portion in a closed shape and through which a mouth portion can be seen is formed in addition to and separately from the eye opening portion.

In a case of the headgear of the invention, the player wears the headgear on his/her head portion and continues to fight while watching movements of an opponent through the eye opening portion through which both eyes can be seen with his/her mouth portion left free by the mouth opening portion through which the mouth can be seen and with impacts of hits by the opponent lessened by the shock absorbing material filled between the surface-side skin material and the back-face-side skin material of the gear main body. Because a feeling of pressure on the mouth portion is removed due to existence of the mouth opening portion, the player can easily speak and breathe. The headgear does not obstruct speaking and breathing of the player. Moreover, the player can visually recognize feet of the opponent through the mouth opening portion to watch movement of the opponent player when both the players approach each other.

Furthermore, as a preferred embodiment of the headgear of the invention, there is the following structure.

The surface-side skin material and the back-face-side skin material are sewn together at a peripheral edge of the eye opening portion in such a manner that a sewing thread is less likely to be exposed on the surface side, the headgear being worn on a head portion of the player to protect mainly a face of the player from a hit by an opponent, a part above the eye opening portion covers a forehead portion, a part between the eye opening portion and the mouth opening portion covers cheek portions and a nose portion, and a part below the mouth opening portion covers a lower jaw portion, the surface-side skin material and the back-face-side skin material are split in a vertical direction between the eye opening portion and the mouth opening portion to form a gap, end portions facing each other at the gap are connected by connecting means in such a manner that left and right spaces between the surface-side skin material and the back-face-side skin material communicate with each other at this gap, and the shock absorbing material is filled also in the communicating space at the gap.

With this structure, because the sewing thread is not substantially exposed on the surface side at the peripheral edges of both the eye and mouth opening portions through which both the eyes and the mouth can be seen, the sawing thread is less likely to be damaged and the sewing thread and the seam are not conspicuous.

On the other hand, the gear main body covers the forehead portion above the eye opening portion, the lower jaw portion below the mouth opening portion, and the cheek portions and the nose portion between the eye opening portion and the mouth opening portion. Moreover, though there is a gap in the surface-side skin material and the back-face-side skin material between the eye opening portion and the mouth opening portion, the end portions facing each other at the gap are connected by the connecting means in such a manner that the left and right spaces between the surface-side skin material and the back-face-side skin material communicate with each other at the gap and the shock absorbing material is filled also in the communicating space at the gap. As a result, the shock absorbing material is disposed in front of the forehead portion, the lower jaw portion, the cheek portions, and the nose portion of the player. Because the hits by the opponent are applied on the forehead portion, the lower jaw portion, and the cheek portions through the shock absorbing material, the shock absorbing material in the gear main body reliably protects the face including the nose portion of the player from the impacts of the hits by the opponent.

On the other hand, at the gap in the surface-side skin material and the back-face-side skin material, various connecting means can be employed.

As a result, with the headgear of the invention, the face including the nose portion of the player can be protected sufficiently and also the player can easily speak and breathe. Moreover, the player can visually recognize feet of the opponent through the mouth opening portion to watch movement of the opponent player when both the players approach each other.

Moreover, to additionally remark about the headgear of the invention, peripheries of both the eye opening portion and mouth opening portion of the gear main body form closed rings when the product is completed. However, when the surface-side skin material and the back-face-side skin material have been sewn together with the sewing thread, the part between the eye opening portion and the mouth opening portion has a gap in a vertical direction, the gap is open without having been sewn, and the eye opening portion and the mouth opening portion are not yet formed as separate opening portions, and therefore, the surface-side skin material and the back-face-side skin material can be turned inside out to position the sewing thread on the back side. In other words, if the surface-side skin material and the back-face-side skin material are sewn together with the sewing thread without a gap between the eye opening portion and the mouth opening portion, the eye opening portion and the mouth opening portion are formed into separate opening portions and therefore the surface-side skin material and the back-face-side skin material cannot be turned inside out to position the sewing thread on the back side. In other words, if the surface-side skin material and the back-face-side skin material are sewn together with the part between the eye opening portion and the mouth opening portion split in the vertical direction while leaving the gap open, it is possible to turn the surface-side skin material and the back-face-side skin material inside out to position the sewing thread on the back side. Moreover, if the opposite sides of the gap of the surface-side skin material and the back-face-side skin material are connected by the string separate from the sewing thread, it is possible to manufacture the headgear of the embodiment without a hitch. With this finding, the inventor has completed the present invention.

As a preferred embodiment of the invention, there is a structure in which a thin rigid material surrounding the eye opening portion of the gear main body is disposed as a shock absorbing core material between the shock absorbing materials at a periphery of the eye opening portion.

With this embodiment, because a shock absorbing function of the shock absorbing material is reinforced by the thin rigid material as the shock absorbing core material, the face of the player can be protected further sufficiently. As the rigid material, an aluminum alloy sheet, a steel sheet, a stainless steel sheet, a reinforced plastic sheet, and the like are preferable and the rigid material is not especially limited as far as the material is lightweight and has high strength.

As a more preferred embodiment of the above embodiment, there is a structure in which the thin rigid material has a gap in a position corresponding to the gap in the surface-side skin material and the back-face-side skin material and end portions of the thin rigid material facing each other at the gap are coupled integrally through a connecting piece.

With this embodiment, the thin rigid material as the shock absorbing core material surrounds the eye opening portion without the gap, the shock absorbing function of the shock absorbing material can be reinforced sufficiently. Moreover, by inserting the thin rigid material between the surface-side skin material and the back-face-side skin material from the gap and then coupling end portions of the thin rigid material by using the connecting piece, the thin rigid material can be installed easily.

As the further preferred embodiment of the above embodiment, there is a structure in which the connecting means is any one of an adhesive, a sawing thread, and a string different from the sawing thread and the thin rigid material is bonded through its whole face to the shock absorbing material.

If the adhesive or the sewing thread is employed as the connecting means, the connecting portion is not conspicuous. If the string different from the sewing thread is employed as the connecting means, the end portions can be connected by using the string having higher strength and tougher than the sewing thread and therefore it is possible to prevent damage to the string even if the string is exposed on the surface side. Because the string connects the gap only, the string is not conspicuous to seriously defile the outward appearance. Because the thin rigid material as the shock absorbing core material is bonded through its whole face to the shock absorbing material, the shock absorbing function of the shock absorbing material can be further reinforced. Moreover, after bonding the thin rigid material to the shock absorbing material in advance, the rigid material and the shock absorbing material can be inserted simultaneously between the surface-side skin material and the back-face-side skin material.

DETAILED DESCRIPTION OF THE PREFERRED EMBODIMENTS

Figure 1:
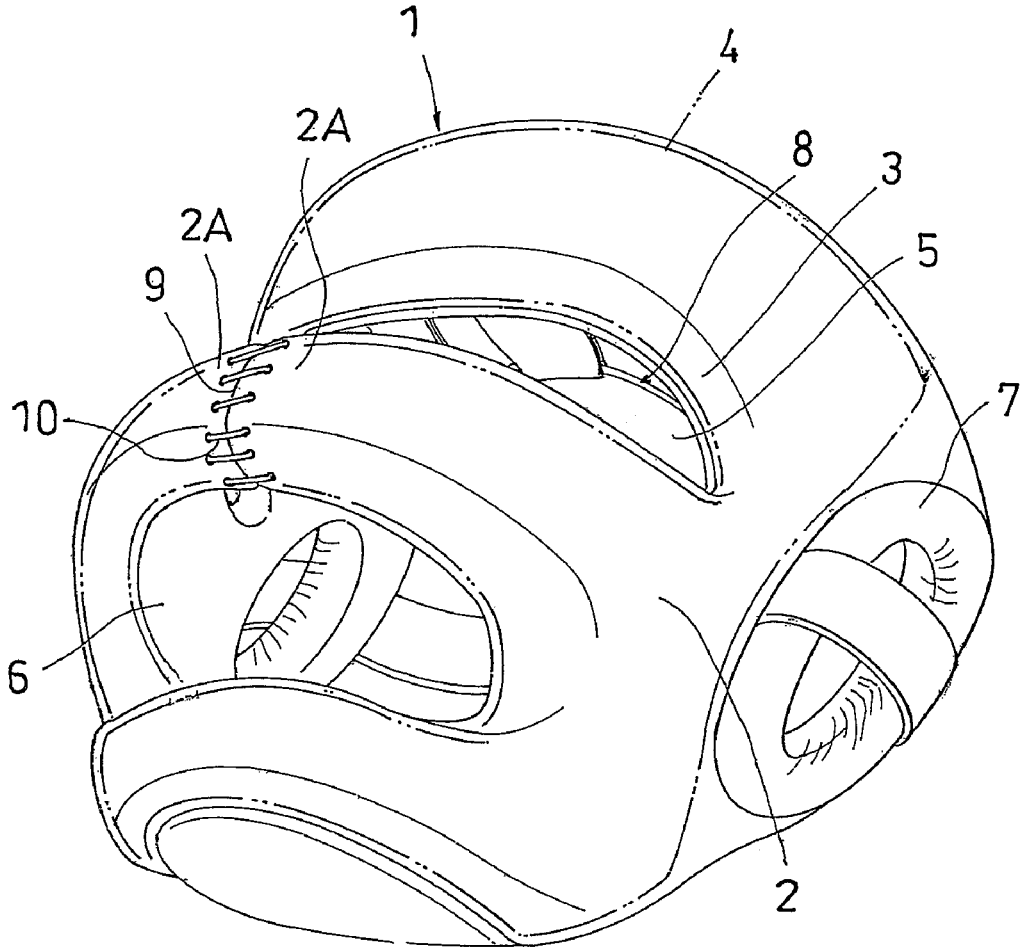
FIG. 1 is a perspective view of a headgear according to an embodiment of the present invention when viewed from the front and diagonally from below.
Figure 2:
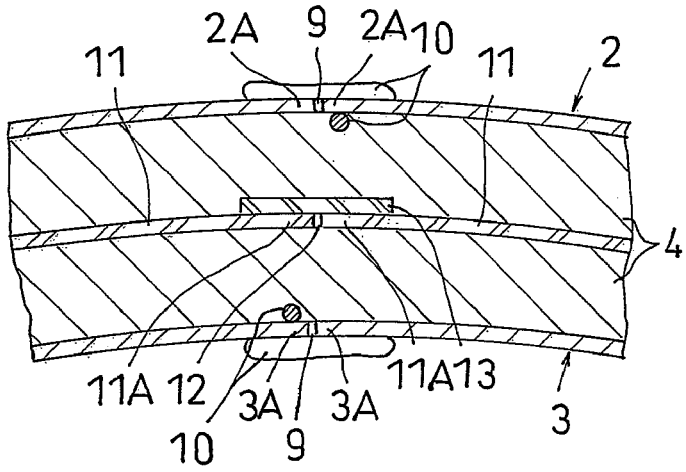
FIG. 2 is a partial sectional view of the headgear in FIG. 1 partially and horizontally cut in a position between positions for eyes and a mouth to show an inside structure.

An embodiment of a headgear according to the present invention will be described specifically with reference to the drawings. FIG. 1 is a perspective view of a headgear according to the embodiment of the invention when viewed from the front and below. FIG. 2 is a partial sectional view of the headgear of the present embodiment partially and horizontally cut in a position between positions for eyes and a mouth to show an inside structure.

The headgear shown in FIG. 1 is worn on a head portion of a player (not shown) of karate, boxing, or the like and includes a gear main body 1 for protecting mainly a face of the player from hits by an opponent. The gear main body 1 includes a shock absorbing material 4 filled between a surface-side skin material 2 and a back-face-side skin material 3 and is formed in the front with an eye opening portion 5 through which both eyes can be seen and which extends leftward and rightward to be long in a lateral direction as shown in FIG. 2. Moreover, a mouth opening portion 6 through which a mount can be seen is formed as an opening separate from the eye opening portion 5.

In a case of this gear main body 1, the surface-side skin material 2 and the back-face-side skin material 3 are sewn together at peripheral edges of the eye opening portion 5 and the mouth opening portion 6 substantially without exposing sewing threads on a surface side. In other words, seams of the threads are positioned on a back face side (on a shock absorbing material side) of the gear main body 1. In this manner, the threads are not exposed substantially on the surface side at the peripheral edges of both the opening portions 5, 6 through which both the eyes and the mouth can be seen and therefore the threads and the seams are not conspicuous. Therefore, the headgear is excellent in beauty and also it is possible to reliably prevent the threads from being worn away, damaged, or cut in use.

Furthermore, an ear ring 7 for protecting the ear of the player is provided on each of left and right sides of the gear main body 1. The headgear is fixed to the head portion by using strings 8 attached to the gear main body 1 and overlaying a piece of a hook and loop fastener on another, the pieces of the hook and loop fastener provided to a back of the head, but a method of fixing the headgear is not limited to this. The headgear may be fixed by using only the hook and loop fastener pieces provided to margins to be overlaid or by using only the strings. Moreover, the ear rings 7 may be detachably fixed to each other with a string from a back side of the head or bands may be attached to both the ear rings 7 to extend the bands and fix them through a hook and loop fastener. In this way, it is possible to further strictly prevent detachment of the headgear during a violent game. In short, it is only essential that the headgear be fixed detachably with some degree of firmness.

The player wearing this headgear can see movement of an opponent from the eye opening portion 5 through which both the eyes can be seen, a feeling of pressure on the mouth portion can be removed due to existence of the mouth opening portion 6 through which the mouth portion can be seen, and the player can continue to play while impacts of the hits by the opponent lessened by the shock absorbing material 4 filled between the surface-side skin material 2 and the back-face-side skin material 3 of the gear main body 1.

As the surface-side skin material 2 and the back-face-side skin material 3 of the gear main body 1, soft skin materials such as artificial leather material or natural leather material are used. The gear main body 1 is finished to be smooth into such a shape as to cover a face and sides of the player and peripheries of the eye opening portion 5 and the mouth opening portion 6 are formed into shapes bulging forward. Normally, a thickness of the shock absorbing material 4 is increased by an amount corresponding to the bulge in each of the bulging portions at the peripheries of the eye opening portion 5 and the mouth opening portion 6 of the gear main body 1 so that the surface of the gear main body 1 protrudes. As specific skin material, artificial leather marketed under the trade name of SOFRINA or the like is preferable, for example, but other materials can be used as far as they have some degrees of strength and softness.

As the shock absorbing material 4, a lamination of a high-density foam having a thickness of about 20 to 45 mm and high sock absorbency, for example, and a high-elasticity foam having a thickness of about 5 to 15 mm, for example can be used. As the high-density foam, there is high-density urethane foam such as Memory Foam developed by NASA and sold by YAMAMITSU OIL CO., LTD., for example. As the high-elasticity foam, there is soft styrene elastomer crosslinked foam manufactured by KDK CORP under the trade name of Pitafoam, for example.

In a case of the gear main body 1, a part above the eye opening portion 5 covers a forehead portion of the player, a part between the eye opening portion 5 and the mouth opening portion 6 covers cheek portions and the nose portion of the player, and a part below the mouth opening portion 6 covers the lower jaw portion of the player to protect it. With regard to protection of the lower jaw portion, the whole lower jaw may be protected deeply or only a tip end of the lower jaw may be protected.

Furthermore, in the gear main body 1, as shown in FIGS. 1 and 2, a vertical gap is formed in substantially central portions of both the surface-side skin material 2 and the back-face-side skin material 3 between the eye opening portion 5 and the mouth opening portion 6 to divide them into the left and right parts. The surface-side skin material 2 and the back-face-side skin material 3 are not sewn together at the gap 9 by using the sewing thread and end portions 2A facing each other and end portions 3A facing each other at the gap 9 are respectively connected by using a string 10 different from the sewing thread in such a manner that left and right spaces between the surface-side skin material 2 and the back-face-side skin material 3 communicate with each other. Moreover, the shock absorbing material 4 is filled also into the communicating space at the gap 9. As a result, the shock absorbing material 4 is disposed in front of the forehead portion, the lower jaw portion, the cheek portions, and the nose portion of the player and the hits by the opponent are applied through the shock absorbing material 4 for the player. In this case, because there is a clearance of about 2 to 5 cm between the shock absorbing material 4 in front of the nose portion and the nose portion, the hits are not directly applied to the nose portion.

The string 10 firmly connects the end portions 2A of the surface-side skin material 2 to each other and the end portions 3A of the back-face-side skin material 3 to each other on a surface side and a back face side of the gap 9 as shown in FIG. 2. As the string 10, there are a string made of synthetic fiber and a string made of natural fiber or a string made of synthetic leather and a string made of natural leather. In this way, the left and right sides of the surface-side skin material 2 and the back-face-side skin material 3 can be connected at the gap 9 by using a high-strength string 10 different from the sewing thread, and therefore it is possible to prevent damage to the string 10 even if the string 10 is exposed on the surface side. Moreover, the string 10 is less conspicuous because it only connects opposite sides of the gap 9. Furthermore, even if the string 10 is damaged, the string 10 can be replaced easily and the replacement is less troublesome than that of the sewing thread.

Figure 3:
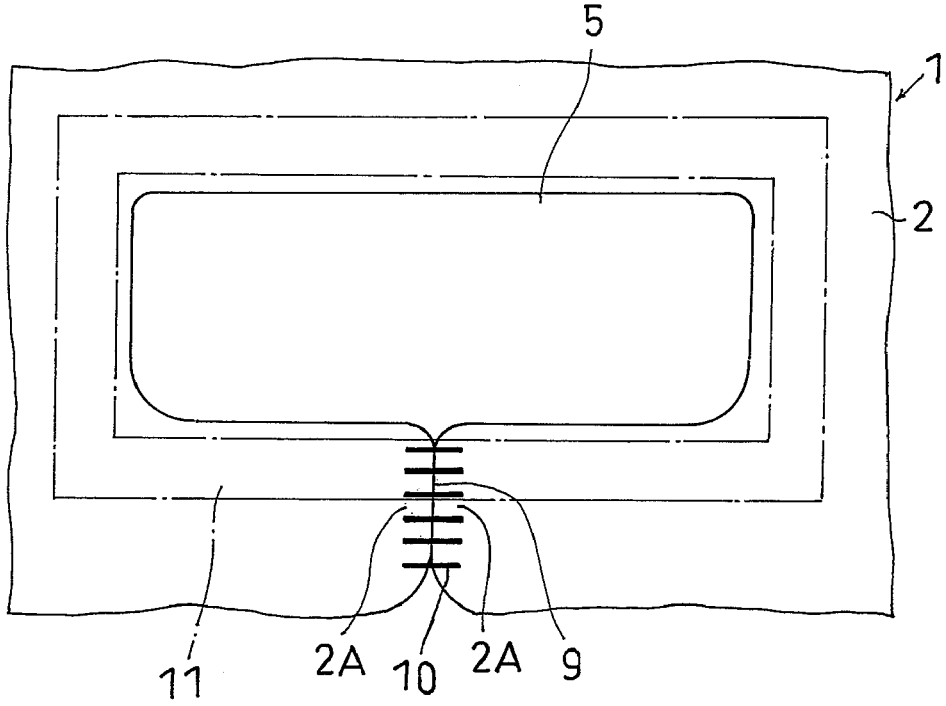
FIG. 3 is a partial front view showing a state of installation of a thin rigid material as a shock absorbing core material in the headgear in FIG. 1.

In the case of the headgear of the embodiment, as shown in FIGS. 2 and 3, at the periphery of the eye opening portion 5 of the gear main body 1, a narrow and thin rigid material 11 is provided as a shock absorbing core material between the shock absorbing materials 4 in such a manner as to surround the eye opening portion 5. As this rigid material 11, there are a steel sheet, a stainless steel sheet, a metal sheet made of light metal such as aluminum alloy, and a sheet made of engineering plastic or FRP (fiber reinforced plastic) having a thickness of about 0.2 to 2 mm and a width of about 10 to 30 mm. Because the shock absorbing function of the shock absorbing material 4 is reinforced by the thin rigid material 11, the face of the player can be protected further reliably.

Figure 4:
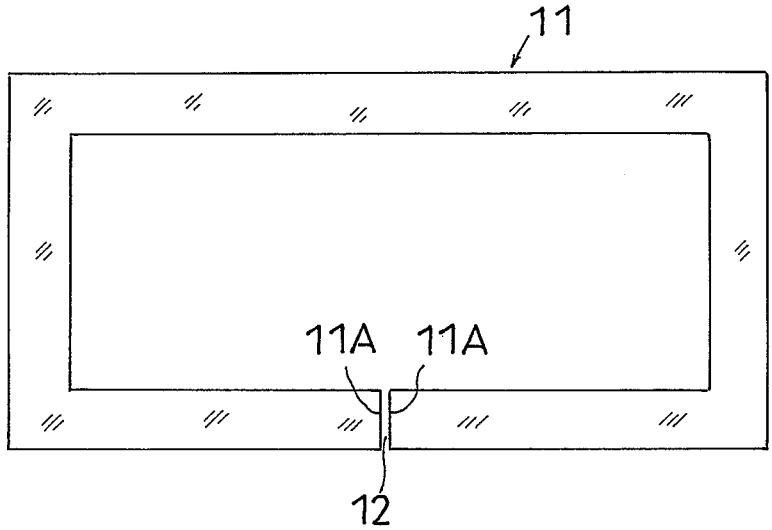
FIG. 4 is a plan view of the thin rigid material as the shock absorbing core material of the headgear in FIG. 1.

The thin rigid material 11 has a break 12 in a position corresponding to the gap 9 in the surface-side skin material 2 and the back-face-side skin material 3 and end portions 11A of the thin rigid material facing each other at the break 12 in the thin rigid material 11 are coupled to be integral with each other by a connecting piece 13 as shown in FIGS. 2 and 4. Therefore, the thin rigid material 11 as the shock absorbing core material surrounds the eye opening portion 5 without a gap and, as a result, the shock absorbing function of the shock absorbing material 4 is sufficiently reinforced. The end portions 11A of the rigid material 11 and the connecting piece 13 may be coupled by welding, screwing, or bonding. As the connecting piece 13, a thin (thickness: about 0.2 to 2 mm, for example) connecting piece made of the same material as the rigid material 11, i.e., metal or FRP (reinforced plastic) can be used.

Figure 5:
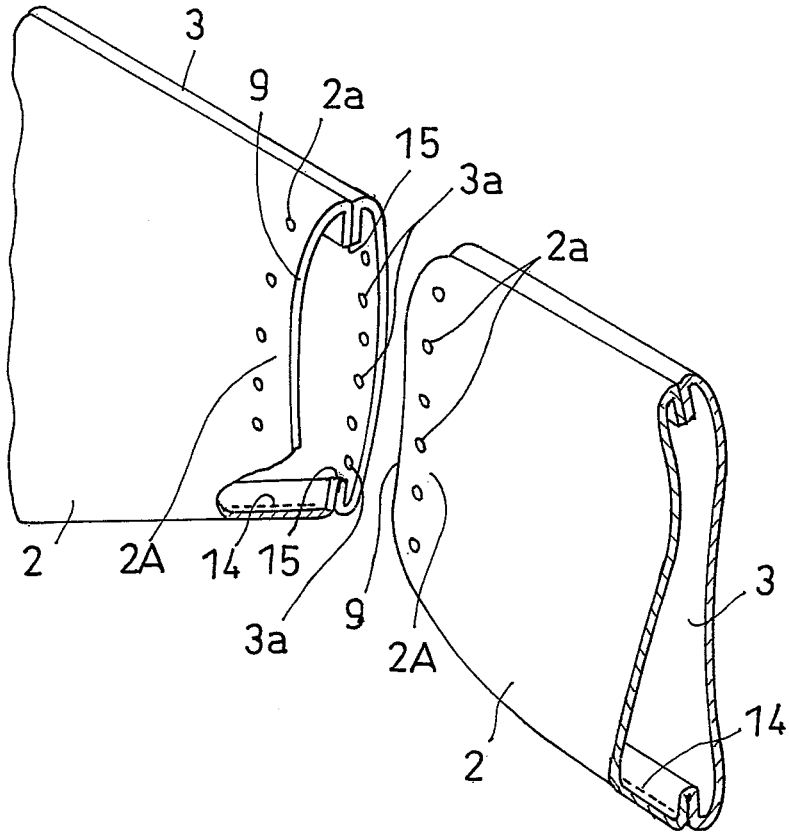
FIG. 5 is a partial cutaway perspective view of a state of a gap in a surface-side skin material and a back-face-side skin material between an eye opening portion and a mouth opening portion in the headgear in FIG. 1.
Figure 6:
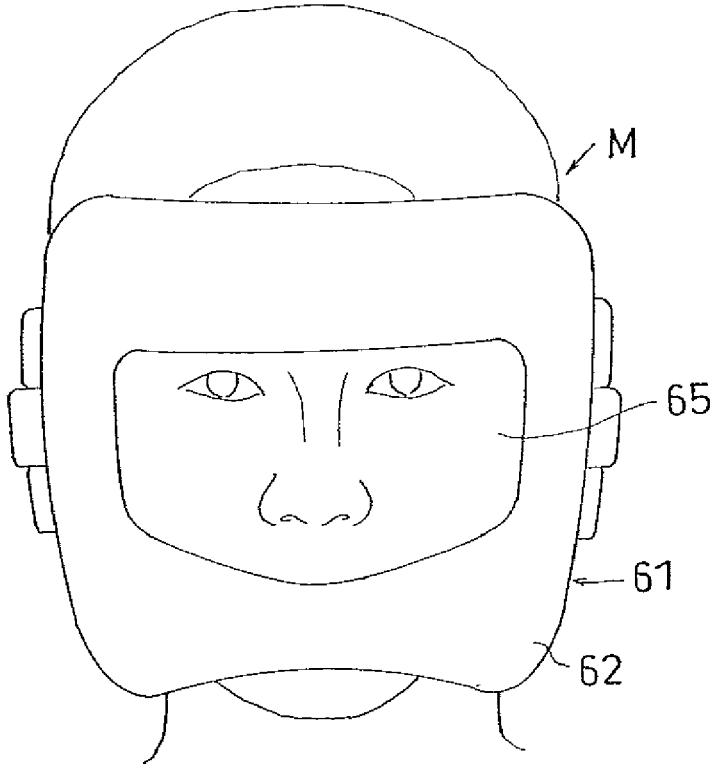
FIG. 6 is a front view of a prior-art headgear.
Figure 7:
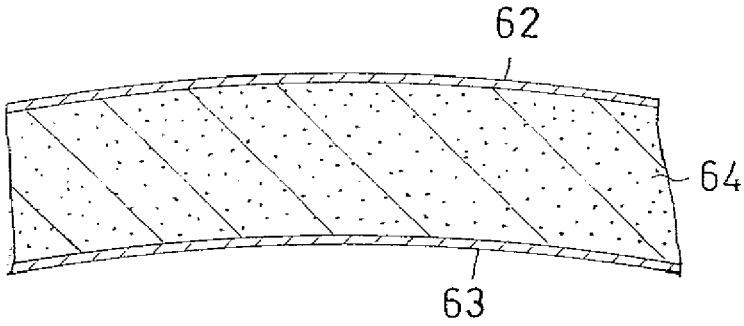
Background Art FIG.7
FIG. 7 is a partial sectional view of an inside structure of the prior-art headgear.

Moreover, to additionally remark about the headgear of the embodiment, peripheries of both the eye opening portion 5 and mouth opening portion 6 of the gear main body 1 form closed rings when the product is completed. However, when the surface-side skin material 2 and the back-face-side skin material 3 have been sewn together with the sewing thread 14 as shown in FIG. 5, the part between the eye opening portion 5 and the mouth opening portion 6 is split in a vertical direction, the gap 9 is open without having been sewn, and the eye opening portion 5 and the mouth opening portion 6 are not yet formed as separate opening portions, and therefore, the surface-side skin material 2 and the back-face-side skin material 3 can be turned inside out to position the sewing thread 14 on the back side.

In other words, if the surface-side skin material 2 and the back-face-side skin material 3 are sewn together with the sewing thread 14 without a gap between the eye opening portion 5 and the mouth opening portion 6, the eye opening portion 5 and the mouth opening portion 6 are formed into separate opening portions and therefore the surface-side skin material 2 and the back-face-side skin material 3 cannot be turned inside out to position the sewing thread 14 and the seam 15 on the back side. In other words, if the surface-side skin material 2 and the back-face-side skin material 3 are sewn together with the part between the eye opening portion 5 and the mouth opening portion 6 split in the vertical direction while leaving the gap open, it is possible to turn the surface-side skin material 2 and the back-face-side skin material 3 inside out to position the sewing thread 14 and the seam 15 on the back side. Moreover, if the opposite sides of the gap 9 of the surface-side skin material 2 and the back-face-side skin material 3 are connected by inserting the string 10 separate from the sewing thread 14 through connecting through holes 2*a*, 3*a* in order and lacing the string 10 up in a manner similar to lacing up of a pair of shoes, it is possible to manufacture the headgear of the embodiment without a hitch. With this finding, the present invention has been completed.

In the headgear of the embodiment, because the thin rigid material 11 has the break 12, before the opposite sides of the gap 9 of the surface-side skin material 2 and the back-face-side skin material 3 are connected by using the string 10, the break 12 in the rigid material 11 (which is thin, elastic, and easy to handle) can be opened up to some extent and one end portion 11A of the rigid material 11 is inserted into one of open sides of the gap 9 of the surface-side skin material 2 and the back-face-side skin material 3. In this way, the rigid material 11 can be inserted easily and the one end portion 11A of the rigid material can be exposed from the other open side of the gap 9. Thus, the rigid material 11 can be disposed in the periphery of the eye opening portion 5. Then, by coupling the end portions 11A of the rigid material 11 through the connecting piece 13, the thin rigid material 11 can be formed integrally.

In this state, the surface-side skin material 2 and the back-face-side skin material 3 have been turned inside out and are positioned at the peripheries of the eye opening portion 5 and the mouth opening portion 6 with the sewing thread 14 positioned on the back side. However, the other end sides of the surface-side skin material 2 and the back-face-side skin material 3 have not been sewn with a thread and are left open. Therefore, in this state, two shock absorbing materials 4 each of which is in a shape having spaces in positions corresponding to the eye opening portion 5 and the mouth opening portion 6 are disposed respectively in such a manner as to sandwich the rigid material 11 positioned between the surface-side skin material 2 and the back-face-side skin material 3.

However, the shock absorbing materials 4 are not disposed in a coupling position where the end portions 11A of the rigid material 11 are coupled through the connecting piece 13. Therefore, the shock absorbing materials 4 are inserted from the gap 9 and attached so as to sandwich the rigid material 11 and the connecting piece 13 positioned at the center from surface and back face sides. Then, the opposite sides of the gap 9 of the surface-side skin material 2 and the back-face-side skin material 3 are connected by using the string 10 so that a clearance is not created. By sewing open ends positioned on the back face side of the gear main body 1 by using a thread and attaching the ear rings 7, the strings 8, and the like, the headgear shown in FIG. 1 can be manufactured.

One face or both faces of the above-described thin rigid material 11 may be bonded in its (their) entirety to the shock absorbing material(s) 4 with an adhesive. If the thin rigid material 11 as the shock absorbing core material is bonded in its entirety to the shock absorbing material 4, the shock absorbing function of the shock absorbing material 4 can be reinforced sufficiently. Moreover, there is also an advantage that the thin rigid material 11 is bonded to the shock absorbing material 4 in advance to simultaneously insert the rigid material 11 and the shock absorbing material 4 between the surface-side skin material 2 and the back-face-side skin material 3.

As described above, in the case of the headgear of the embodiment, because a mouth of the player is left free (to speak, breathe, and the like) by the mouth opening portion 6, the player can easily speak and breathe and can even drink water without removing the headgear from the head portion. Moreover, the hits by the opponents are applied to the forehead portion, the lower jaw portion, and the cheek portions through the shock absorbing material 4 and therefore the shock absorbing material 4 of the gear main body 1 reliably protects the face including the nose portion of the player from the impacts of the hits by the opponent.

As a result, the headgear of the embodiment is less likely to be displaced during the play, the headgear sufficiently protects the face including the nose portion of the player, and player can easily speak and breathe and does not feel difficulty in breathing.

Other Embodiments (1) Although the example in which the gap 9 is formed in the vertical direction between the eye opening portion 5 and the mouth opening portion 6 has been shown in the embodiment, it is also possible to form a similar gap between the eye opening portion 5 and the forehead portion. In this case, the end portion 11A of the shock absorbing core material 11 formed of the thin rigid material is inserted from the gap between the eye opening portion and the forehead portion. When the insertion is completed, the end portions 11A of the shock absorbing core material 11 are similarly connected and integrated by using a connecting piece 13. Then, by disposing the shock absorbing material 4, a headgear formed with the eye opening portion 5 and the mouth opening portion 6 and similar to that shown in FIG. 1 can be manufactured.

(2) Although the thin rigid material 11 is formed into a rectangular shape with an opening as shown in FIG. 4 so as to effectively facilitate dispersion of force of the hit in the above embodiment, it is alternatively possible to form the rigid material 11 into a substantially H shape, though this shape is somewhat inferior in the effect of dispersing the force of the hit. In other words, the thin rigid material is formed into shapes of half bodies obtained by cutting a substantially central portion of a bridge portion connecting left and right parallel portions of the H shape, the half bodies are disposed so that the left and right parallel portions face front faces of the cheek portions and the bridge portions face the nose portion, and the half bodies are secured to and integrated with each other by the above-described connecting piece 13. In this manner, the high shock absorbing effect can be obtained.

(3) Although the example in which the shock absorbing material 4 is the lamination has been shown in the above embodiment, the shock absorbing material 4 is not necessarily the lamination but may be a single-layer material made of either one of the high-density foam and the high-elasticity foam having high shock absorbency.

(4) As another embodiment, there is a headgear similar to the above embodiment except that a thin rigid material is provided as a shock absorbing core material also at the periphery of the mouth opening portion 6 so as to surround the mouth opening portion 6.

(5) Although the example in which the end portions 2A of the surface-side skin material 2 are firmly connected and the end portions 3A of the back-face-side skin material 3 are firmly connected on the surface and back sides of the gap 9 by using the string 10 has been described in the above embodiment, it is alternatively possible to connect the opposite sides of the gap 9 by using the adhesive and it is also possible to connect them by using a sawing thread, which advantageously makes the seam less conspicuous than that formed by using the string.

(6) Although the example in which the end portions 2A of the surface-side skin material 2 are firmly connected and the end portions 3A of the back-face-side skin material 3 are firmly connected on the surface and back sides of the gap 9 by using the string 10 has been described in the above embodiment, it is alternatively possible to integrally form and manufacture the headgear of the invention by casting resin, e.g., polyurethane into a mold in a shape of the headgear. In this case, it is possible to employ a method of using cores at portions corresponding to the eye opening portion and the mouth opening portion to form the openings. It is of course possible to dispose the thin rigid material in the mold to form the headgear as shown in FIG. 3.

The invention claimed is:

1. A headgear comprising a gear main body comprising:

a surface-side skin material;

a back-face-side skin material; and a shock absorbing material filled between the surface-side and back-face-side skin materials, wherein the headgear being worn on a head portion of a player to protect mainly a face of the player from a hit by an opponent, an eye opening portion having a single opening in a close shape, through which single opening both eyes of the player can be seen, is formed in the front, a mouth opening portion having a single opening in a closed shape, through which single opening a mouth portion of the player can be seen, is formed in addition to and separately from the eye opening portion in the front, a part between the eye opening portion and the mouth opening portion for covering cheek portions and a nose portion of the player has a seam extending from the eye opening portion to the mouth opening portion, the surface-side skin material and the back-face-side skin material are split in a vertical direction between the eye opening portion and the mouth opening portion at the seam to form a gap, and a part above the eye opening portion for covering a forehead portion of the player and a part below the mouth opening portion for covering a lower jaw portion are further formed, end portions facing each other at the seam are connected by connecting means in such a manner that left and right spaces between the surface-side skin material and the back-face-side skin material communicate with each other, and the shock absorbing material is filled also in the communicating space at the seam, wherein the surface-side skin material and the back-face-side skin material are sewn together with a sewing thread all around the eye opening portion and all around the mouth opening portion except the gap between the eye opening portion and the mouth opening portion with seams being turned inside out, such that the sewing thread is positioned on the back-face side of the head gear except the seam of the part between the eye opening portion and the mouth opening portion.

2. A headgear according to claim 1, wherein a thin rigid material surrounding the eye opening portion of the gear main body is disposed as a shock absorbing core material between the shock absorbing materials at a periphery of the eye opening portion.

3. A headgear according to claim 2, wherein the thin rigid material has a gap in a position corresponding to the gap in the surface-side skin material and the back-face-side skin material and end portions of the thin rigid material facing each other at the gap are coupled integrally through a connecting piece.

4. A headgear according to claim 3, wherein the connecting piece is made of metal or FRP which is the same as a material of the thin rigid material and has a thickness of 0.2 to 2 mm.

5. A headgear according to claim 1, wherein the connecting means is any one of an adhesive, a sawing thread, and a string different from the sewing thread and the thin rigid material is bonded through its whole face to the shock absorbing material.

6. A headgear according to claim 1, wherein an ear ring for protecting an ear of the player is provided to each of left and right sides of the gear main body.

7. A headgear according to any one of claims 1, wherein the shock absorbing material is made of a lamination of a high-density foam having a thickness of 20 to 45 mm and high shock absorbency and a high-elasticity foam having a thickness of 5 to 15 mm.

* * * * *

UNITED STATES PATENT AND TRADEMARK OFFICE

CERTIFICATE OF CORRECTION

PATENT NO. : 7,739,752 B2
APPLICATION NO. : 11/556996
DATED : June 22, 2010
INVENTOR(S) : Takeshi Tsujimoto It is certified that error appears in the above-identified patent and that said Letters Patent is hereby corrected as shown below:

Column 9, line 15; Change “portion and” to --portion 5 and--.

Column 11, line 5; In claim 7, change “any one of claims” to --claim--.

Signed and Sealed this
First Day of February, 2011

David J. Kappos

David J. Kappos
*Director of the United States Patent and Trademark Office*